United States Patent [19]

Stocker

[11] 3,947,164

[45] Mar. 30, 1976

[54] ROTATABLE MACHINE OPERATING AS A COMPRESSOR OR A MOTOR

[75] Inventor: Jean Stocker, Colombier, Switzerland

[73] Assignee: Compresseurs S.A., Colombier, Switzerland

[22] Filed: Oct. 18, 1974

[21] Appl. No.: 515,837

[52] U.S. Cl. ..... 418/233

[51] Int. Cl.[2] ..... F04C 17/00

[58] Field of Search ..... 418/226, 218, 233, 260, 418/261

[56] References Cited

UNITED STATES PATENTS

| | | | |
|---|---|---|---|
| 375,788 | 1/1888 | Williamson | 418/233 |
| 1,892,345 | 12/1932 | Hughes | 418/226 |
| 2,557,427 | 6/1951 | Gibson | 418/233 |
| 3,895,893 | 7/1975 | Sommer | 418/233 X |

*Primary Examiner*—C. J. Husar
*Assistant Examiner*—Leonard Smith
*Attorney, Agent, or Firm*—Silverman & Cass, Ltd.

[57] ABSTRACT

A rotatable machine for operation as a compressor or a motor. A stator rotates a rotor positioned therewithin. The rotor variably limits the radial section of an annular space or room. The rotor carries a series of blades rotatably mounted thereon and positioned within the room. The machine includes control means impelling the blades to oscillating movement synchronized with the rotation of the rotor such that the blades move themselves as a function of the angular position of the rotor and thereby divide the room into partitions, each having the shape of a segment of a crown.

7 Claims, 14 Drawing Figures

FIG. 11
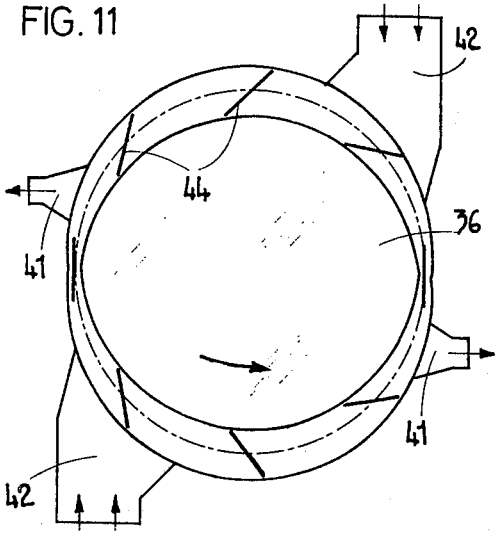
FIG. 12
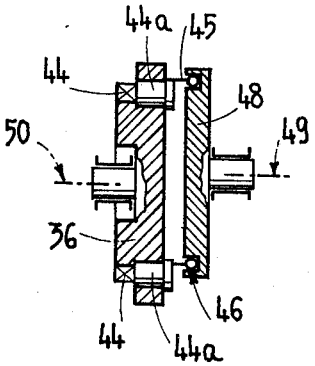
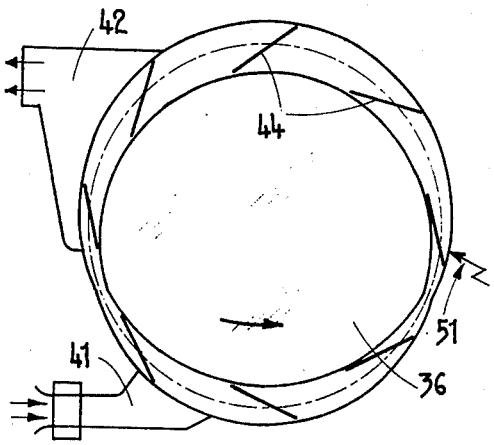
FIG. 13
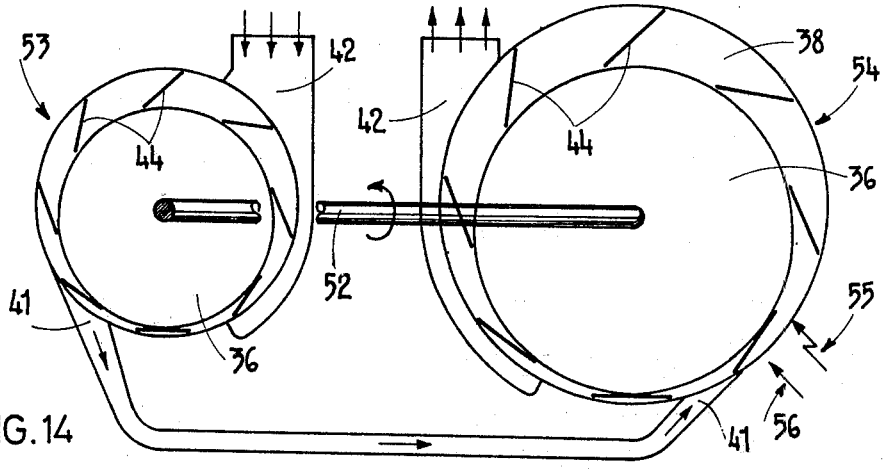
FIG. 14

ROTATABLE MACHINE OPERATING AS A COMPRESSOR OR A MOTOR

SUMMARY OF THE INVENTION

The present invention provides a rotatable machine operating as a compressor or a motor, the machine comprising a stator inside which rotates a rotor, the rotor and stator limits an annular space or room, the radial section of which varies; the rotor carries a series of blades rotatably mounted thereon, positioned in the said room; the machine includes control means impelling the said blades to oscillating movement synchronized with the rotation of the rotor in such a way that the blades move themselves as a function of the angular position of the rotor and thus divide the said room into partitions, each having the shape of a segment of crown.

The machine is characterized by the fact that control of the blades is ensured by means of a control member provided with an annular groove in which are engaged crank-pins of crank-shafts operating the said blades.

BRIEF DESCRIPTION OF THE DRAWINGS

The drawing shows, by way of example, two embodiments of the invention and two modifications thereof.

FIG. 11 is a diagrammatic side profile view of a modification of the machine of FIG. 9.

FIG. 12 is a diagrammatic axial sectional view, similar to that of FIG. 10, illustrating the principle of operating of the machine of FIG. 11.

FIG. 13 is a diagrammatic side profile view of a modification of the machine of FIG. 9, and FIG. 14 is a diagrammatic side profile view of a machine constructed with the combined use of two machines according to the embodiment of FIG. 9.

DESCRIPTION OF THE PREFERRED EMBODIMENTS

Figure 1:
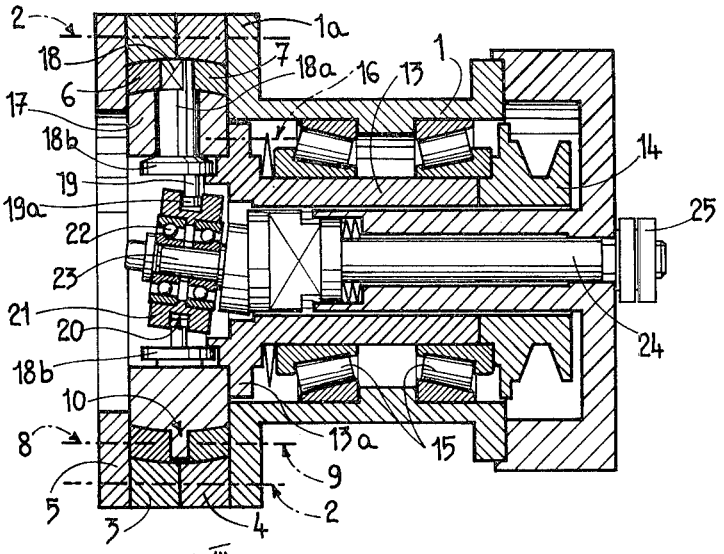
FIG. 1 is a longitudinal sectional view of a first embodiment of the rotatable machine of the invention.
Figure 2:
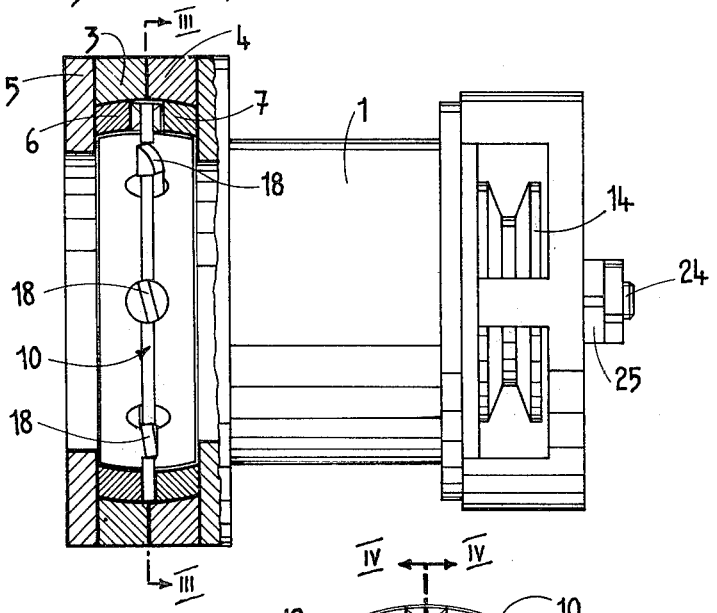
FIG. 2 is an elevational view thereof, with portions shown in section.
Figure 3:
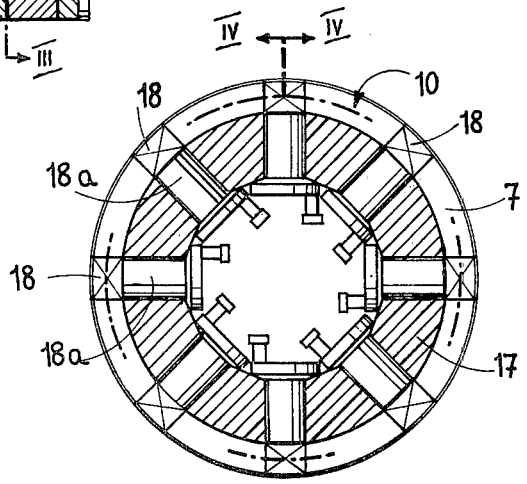
FIG. 3 is a sectional view taken along the line III—III of FIG. 2 in the direction indicated generally.

The machine represented in FIGS. 1 to 4 comprises a tubular body 1 provided, at one of its ends, with an annular flange 1*a* to which are secured, by means of longitudinal screws 2 (diagrammatically shown by dotted lines in FIG. 1), two distance pieces 3 and 4 maintaining at a distance from the flange 1*a* an annular plate 5. Two rings 6 and 7 are located between the plate 5 and the flange 1*a* and are respectively secured to the said plate and to the said flange, by means of screws 8 and 9 (diagrammatically shown by dotted lines in FIG. 1).

Figure 4:
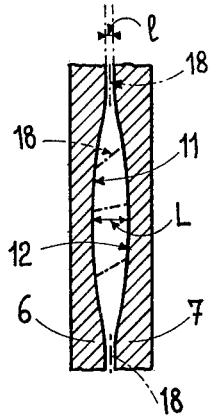
FIG. 4 is a developed sectional view taken along the line IV—IV of FIG. 3, at a smaller scale.

The two rings 6 and 7 thus provide therebetween a free annular space or room 10 having the shape of a groove opening radially towards the inside of the stator 1. The respective axial faces 11 and 12 of the two rings 6 and 7 opposed to each other (FIG. 4) are not plane, and the width of the groove 10 consequently varies but its depth remains constant. FIG. 4, which is a developed sectional view of the groove 10, shows that the width thereof is defined by a minimum dimension *l* and by a maximum dimension L, in two diametrically opposed points.

The rotor of the machine comprises a tubular piece 13, rigidly connected with a wheel 14. The tubular piece 13 is rotatably mounted, by means of roller bearings 15, inside of the tubular stator 1. The tubular member 13 is provided with a terminal flange 13*a* to which is secured, by means of screws 16 (only one of which is diagrammatically shown in FIG. 1), an annular member 17 carrying, articulated thereon, eight blades 18 each of which is rigidly connected to a journal 18*a* radially mounted on the annular member 17 and which can rotate thereon. Each journal 18*a* is provided with a shoulder 18*b* carrying an eccentric control crank-pin 19.

The control crank-pins 19 of the blades 18 are engaged in an annular groove 20 provided in a ring 21 rotatably mounted, by means of a rolling bearing 22, on a stationary journal 23, the axis of which is inclined with respect to the longitidunal axis of the machine. The journal 23 is rigidly connected with an axis 24 which can be slightly moved axially by means of a nut 25, upon initial adjustment of the machine, this axial movement having no bearing on the operation of the machine.

The operation of the machine as disclosed and represented is as follows:

During the rotation of the rotor 13–17, the blades 18 effect an oscillating movement synchronized with the rotor. The oscillating movement of the blades 18 causes them to occupy successively the positions represented in dot-and-dash lines in FIG. 3. As a result of this movement, the blades 18 divide permanently the room 10 into partitions having the shape of segments of crown. The distance pieces 3 and 4 are provided with two passages permit input and output of air or of gas into the said room. The machine can operate either as a pump or compressor, in which case the rotor will be driven by means of the pulley wheel 14, or as a motor, the room 10 being then provided with means for igniting of the combustible gaseous mixture that is contained therein and the pulley wheel 14 operating to transmit the force.

The blades 18 being controlled positively, there is no friction between them and the walls of the room 10. Moreover, the control ring 21 being rotatable, it follows the rotation of the rotor, being driven by the crank-pins 19, so that there is also no friction between the ends of the crank-pins, which are provided with the head 19*a* having the shape of a segment of sphere, and the walls of the groove 20. It is to be noted that if the ring 21 is stationary, the kinematics would remain the same but friction would occur between the walls of the groove 20 and the heads 19*a* of the crank-pins 19.

The machine has the advantage of operating continuously, without alternative movements except for that of the blades 18, thereby requiring no lubrication and producing no friction.

The amplitude of the oscillating movements of the blades 18 and, consequently, the volumetric ratio of the rooms 10, is determined by the inclination of the control ring 21 with respect to the longitudinal axis of the machine. If this ratio is required to be high, that is to say if the ratio of the width *l*/L of the room 10 is high, the inclination of the journal 23, and consequently of the ring 20, must be higher than if this ratio is low. The eccentricity of the crank-pins 19 with respect to the axis of the journals 18*a* of the blades 18 also obviously must be determined correspondingly.

Figure 5:
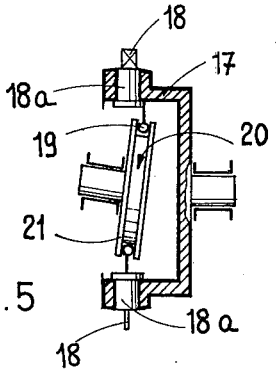
FIG. 5 is a sectional view illustrating the principle of operating of the machine represented in FIGS. 1 to 4.

As shown in FIG. 5, the axial position of the control ring 21 is such that, at two diametrically opposed points, through which the section of FIG. 5 is passed, the groove 20 of the ring 21 is on the one hand at its maximum of eccentricity with respect to the axis of the journals 18*a*, as it is the case for the upper blade of FIG. 5, and on the other hand at its minimum of eccentricity, that is to say zero, as it is the case for the lower blade. In view of this arrangement, the machine operates at two cycles, the room 10 passing from a minimum of volume to a maximum of volume and return to its minimum of volume at each complete revolution of the rotor.

Figure 6:
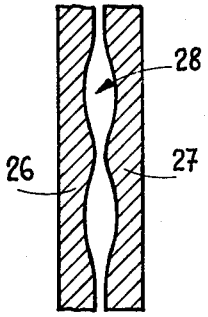
FIG. 6 is a developed sectional view, similar to that of FIG. 4, showing a modification.
Figure 7:
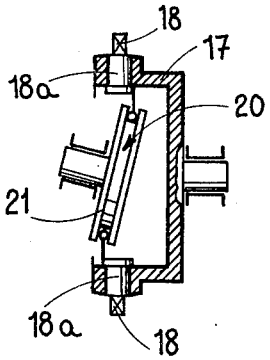
FIG. 7 is a diagrammatic axial sectional view illustrating the principle of operating of the modification of FIG. 6.

The same machine could also operate at four cycles, in which case the width of the room is provided with two minimums and two maximums as is the case in the modification of FIG. 6. In FIG. 6 there are shown two rings 26 and 27 limiting the room. The rings 26 and 27 correspond respectively to the rings 6 and 7 of the first embodiment discussed above. As it can be seen, the minimum widths *l*, as well as the maximum widths L are diametrically opposed; the minimum widths are shifted 90° with respect to the maximum widths. The room, 28 is thus provided with two minimum sections alternating with two maximum sections. In order for the blades 18 to effect double oscillating movements as in the first embodiment, the control ring 21 has been moved axially with respect to its position in the first embodiment and is also more inclined. The result is that, at two diametrically opposed points, shown in the section of FIG. 7, the groove 20 of the ring 21 is at its maximum of eccentricity with respect to the axis of the journals 18*a*. In FIG. 7 the two points of minimum eccentricity, that is to say zero, are not visible in the since they are in a plane perpendicular to the one shown in the section of FIG. 7.

Figure 8:
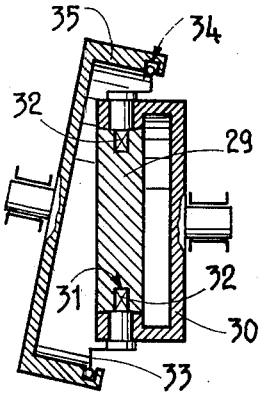
FIG. 8 is a diagrammatic axial sectional view of a modification shown in the machine of FIGS. 1 to 4.

The modification of FIG. 8 is distinguishable from the first embodiment by the fact that the stator 29, diagrammatically represented, is positioned within the rotor 30, which is bell-shaped. The groove providing the room 31 is provided in the outer cylindrical face of the stator 29, while the blades 32 rotatably mounted on the rotor 30 and disposed radially with respect to the axis thereof, are located within the rotor. The control crank-pins 33 of the blades 32 are positioned outside of the rotor 30 and are engaged within an annular groove 34 provided on the inner facing surface of the control piece constituted by a ring 35, the axis of which is inclined with respect to that one of the rotor.

Figure 9:
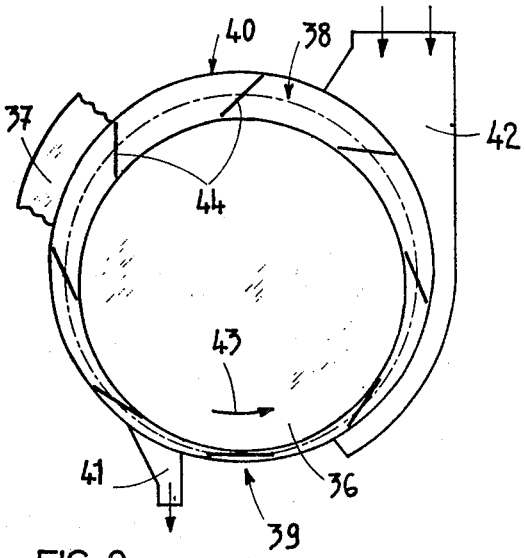
FIG. 9 is a diagrammatic side profile view of a second modification of a rotatable machine.
Figure 10:
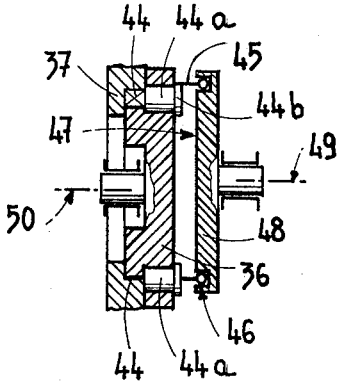
FIG. 10 is a diagrammatic axial sectional view of a portion of the machine of FIG. 9, illustrating its principle of operating.

In the embodiment of FIGS. 9 and 10, the blades have their axes directed parallel to the axis of the rotor and equally radially as in the first embodiment.

In the FIGS. 9 and 10 embodiment, which is diagrammatically shown, the rotor 36 rotates inside the stator 37 and is mounted eccentrically with respect thereto. The room 38 is constituted by the free space provided between the rotor 36 and the stator 37. The width of the room 38, not visible in the drawing, is constant while its dimension measured radially passes through a minimum, situated at 39, for reaching a maximum at a point 40 which is diametrically opposed thereto. A manifold 41 opens into the room 38 in the vicinity of its point 39 of minimum section, while a manifold 42 opens into the portion of the room the section of which increases in the direction of rotation of the rotor 36 indicated by the arrow 43.

The blades 44 are constructed of one piece with journals 44*a* rotatably mounted in the rotor 36, parallel to the axis thereof. The journals 44*a* are each provided with a shoulder 44*b* carrying a crank-pin 45 engaged in a circular groove 46 provided in the axial face 47 of a control disc 48 rotatably mounted and the axis 49 of which is slightly eccentric with respect to the axis of rotation of the rotor 36. The circular groove 46 is coaxial with the disc 48.

The operation of this embodiment is identical to that of the first embodiment.

It is to be noted that, when modifying the diameter of the groove 46, the amplitude of the oscillating movements of the blades is varied, thus enabling a choice of different volumetric ratios.

In the case of FIGS. 9 and 10, the operation of the machine is of two cycles so that, at two diametrically opposed points, through which the section of FIG. 10 is passed, the groove 46 is on the one hand at its maximum of eccentricity with respect to the axis of the journals 44*a*, as is the case for the upper blade of FIG. 10, and on the other hand at its minimum of eccentricity, that is to say zero, as is the case for the lower blade.

When modifying the eccentricity of the control piece 48 with respect to the rotor 36, an operation of four cycles, can be obtained. In this case the shape of the rotor will be such that it gives to the annular room two maximum sections and two minimum sections diametrically opposed, the maximum being however shifted 90° with respect to the minimum. This is the case in the modification of FIGS. 11 and 12 where the same reference numerals as those of the embodiment of FIGS. 9 and 10 have been used.

In order that the blades 44 effect double the oscillating movements of the first embodiment, the control plate 48 has been displaced laterally with respect to the position it occupies in the first embodiment, and the diameter of the groove 46 has been modified.

While the machine according to the embodiment of FIGS. 9 and 10 is intended to operate as a pump or a compressor, the modification of FIG. 13, in which the same reference numerals have been used, is intended to operate as a motor, the ignition of the gas contained in the room being effected at 51.

FIG. 14 shows a mounting using two machines of the type shown in FIGS. 9 and 10, each being of two cycles and coupled to each other by means of a shaft 52. The machine 53 shown on the left side of FIG. 14 operates as a compressor, and the machine 54 shown on the right side of FIG. 14 operates as a motor. Ignition is effected at 55 and an injection of gasoline is provided at 56. The ratio between the compressor and the motor can be choosen in such a way that decompression is effected totally in the zone of the room 38 of the motor 54 located between the ignition point and the output opening 42. The results are that the gasses are burned more effectively than in a conventional motor, that the efficiency of operation is increased, and the motor is less noisy and less polluant. Notwithstanding the fact that the FIG. 14 apparatus comprises two cycle machines, the combination operates at four cycles.

What I claim is:

1. A rotatable machine for operation as a compressor or a motor comprising, a stator, a rotor positioned within the stator for rotation, a room defined by the rotor, the room having a longitudinal dimension which is variable, a set of blades carried by the rotor and rotatably mounted thereon, the blades being disposed in said room, control means for impelling oscillating movement to the blades, the movement of the blades being synchronized with the rotation of the rotor such that the blades move as a function of the angular position of the rotor to thereby divide the room into partitions, each partition having the shape of a segment of a crown, a control piece having an annular groove, the control piece being rotatable with the rotor, and a plurality of crank-shafts having crank-pins engaged in the groove for controlling operation of the blades, the control piece being driven by the crank-pins such that there is no slipping friction between the control piece and the crank-pins.

2. A machine as claimed in claim 1 in which the rotor is eccentrically mounted within the stator, the room being of annular configuration and including a free space formed between the rotor and the stator, the free space having a radial dimension which varies and an axial dimension which is constant, the blades having axes of oscillation and said axes being arranged axially on the rotor, the annular groove in which said control crank-pins are engaged being provided in the axial face of the control piece, the axis of the annular groove being eccentric with respect to the axis of the rotor, the control crank-pins being positioned on the axial face of the rotor opposed to the face on which the blades are positioned.

3. A machine as claimed in claim 1 in which the rotor and the stator are coaxially arranged, the room being of annular configuration and defined by a groove opening radially and provided in the cylindrical face of the stator, the axial dimension of the room being variable and the radial depth of the room being constant, said blades having axes of oscillation and said axes being arranged radially on the rotor, the annular groove in which said control crank-pins are engaged being provided in the cylindrical face of the control piece, the axis of the annular groove being inclined with respect to the axis of the rotor.

4. A machine as claimed in claim 3 in which the rotor and the stator are of annular configuration, the groove defining the room being provided in the inner cylindrical face of the stator, the control crank-pins for operation of the blades being disposed within the rotor and the control piece, the control piece having an outer cylindrical face with the groove for receiving the crank-pins provided thereon.

5. A machine as claimed in claim 3 in which the rotor is of annular configuration and the stator is positioned within the rotor, the annular groove defining the room being provided in the outer cylindrical face of the stator, the control crank-pins for operation of the blades being disposed within the rotor and the control piece, the control piece having a ring, an inner cylindrical face of the ring including the groove for receiving said crank-pins.

6. A machine as claimed in claim 3 in which the room has a point in which its width is of maximum value and a point in which its width is of minimum value, said two points being diametrically opposed one with respect to the other.

7. A machine as claimed in claim 3 in which the room has two points in which its width is of maximum value, said two points being diametrically opposed to each other, and two points in which its width is of minimum value, said last defined two points being diametrically opposed to each other and being arranged at 90° with respect to the two points in which the width is of maximum value.

* * * * *

UNITED STATES PATENT AND TRADEMARK OFFICE

CERTIFICATE OF CORRECTION

PATENT NO. : 3,947,164

DATED : March 30, 1976

INVENTOR(S) : JEAN STOCKER

It is certified that error appears in the above-identified patent and that said Letters Patent are hereby corrected as shown below:

On the cover page, before the classification data, read the following:

[30] FOREIGN APPLICATION PRIORITY DATA

November 2, 1973 Switzerland 15,442/73

Signed and Sealed this

Thirteenth Day of July 1976

[SEAL]

*Attest:*

RUTH C. MASON
*Attesting Officer*

C. MARSHALL DANN
*Commissioner of Patents and Trademarks*